US010527326B2

(12) United States Patent
Tanaka

(10) Patent No.: US 10,527,326 B2
(45) Date of Patent: Jan. 7, 2020

(54) COLD AND HOT STORAGE

(71) Applicant: FSX, INC., Kunitachi-shi, Tokyo (JP)

(72) Inventor: Yukihiro Tanaka, Yokohama (JP)

(73) Assignee: FSX, INC., Kunitachi-shi, Tokyo (JP)

( * ) Notice: Subject to any disclaimer, the term of this patent is extended or adjusted under 35 U.S.C. 154(b) by 39 days.

(21) Appl. No.: 15/580,857

(22) PCT Filed: Oct. 17, 2016

(86) PCT No.: PCT/JP2016/080664

§ 371 (c)(1),
(2) Date: Dec. 8, 2017

(87) PCT Pub. No.: WO2017/191694

PCT Pub. Date: Nov. 9, 2017

(65) Prior Publication Data

US 2018/0156504 A1 Jun. 7, 2018

(30) Foreign Application Priority Data

May 2, 2016 (JP) ..... 2016-092224

(51) Int. Cl.
*F25B 21/04* (2006.01)

(52) U.S. Cl.
CPC ..... *F25B 21/04* (2013.01); *F25B 2321/0211* (2013.01); *F25B 2321/0212* (2013.01)

(58) Field of Classification Search
CPC ..... F25B 21/04; F25B 2321/0212; F25B 2321/0211; F25D 23/12; F25D 11/00; F24F 5/0042
See application file for complete search history.

(56) References Cited

U.S. PATENT DOCUMENTS 4,301,658 A * 11/1981 Reed ..... F25B 21/04 165/253
4,328,676 A * 5/1982 Reed ..... F25B 21/04 62/3.62

(Continued)

FOREIGN PATENT DOCUMENTS

JP 3053716 U 11/1998
JP H11-316074 A 11/1999

(Continued)

OTHER PUBLICATIONS

JP2001221551A Translation (Year: 2001).*

(Continued)

*Primary Examiner* — Brian M King
(74) *Attorney, Agent, or Firm* — Chiesa Shahinian & Giantomasi PC

(57) ABSTRACT

A cold and hot storage includes a main body portion, an inner tank arranged in the main body portion, a temperature control heat sink, a heater that heats the temperature control heat sink, a temperature control fan that blows air in the inner tank to fins of the temperature control heat sink, a shielding plate that shields an area where the temperature control heat sink is arranged, a heat dissipation heat sink arranged outside the rear surface of the inner tank, a heat dissipation fan that blows air outside the inner tank to the heat dissipation heat sink, a Peltier module having a heat absorbing surface to be connected to the temperature control heat sink and a heat dissipating surface to be connected to the heat dissipation heat sink, and a power control unit.

20 Claims, 15 Drawing Sheets

(56) References Cited

U.S. PATENT DOCUMENTS

| | | | | |
|---|---|---|---|---|
| 2012/0186272 | A1* | 7/2012 | Son | F25B 21/04 62/3.3 |
| 2014/0157794 | A1* | 6/2014 | McGann | F25B 21/04 62/3.2 |

FOREIGN PATENT DOCUMENTS

| | | | | |
|---|---|---|---|---|
| JP | 2001-221551 | A | | 8/2001 |
| JP | 2001221551 | A | * | 8/2001 |
| JP | 3135138 | U | | 9/2007 |
| JP | 2013-11397 | A | | 1/2013 |

OTHER PUBLICATIONS

International Preliminary Report on Patentability dated Nov. 6, 2018, in connection with International Patent Application No. PCT/JP2016/080664, 7 pgs.

International Search Report and Written Opinion dated Dec. 26, 2016, in connection with International Patent Application No. PCT/JP2016/080664, 6 pgs.

* cited by examiner

COLD AND HOT STORAGE

CROSS-REFERENCE TO RELATED APPLICATIONS

This application is a national stage (under 35 U.S.C. 371) of International Patent Application No. PCT/JP2016/080664, filed Oct. 17, 2016, which claims priority to Japanese Patent Application No. 2016-092224, filed May 2, 2016, the disclosures of which are incorporated herein by reference in their entirety.

BACKGROUND OF THE INVENTION

The present invention relates to a cold and hot storage that cools and heats storage material.

Conventionally, a wet towel, for example, a cooled or a heated wet towel is provided for a customer, depending on the season or the temperature in order to improve service for a customer at, for example, a showroom, a hotel, and a restaurant. Generally, a cold and hot storage capable of cooling or heating a wet towel is used in a case of providing a cooled or heated wet towel for a customer. Such a cold and hot storage, which is known, includes: a box-shaped thermal conductor including a metal having good thermal conductivity, such as an aluminum, an aluminum alloy or the like; an electrothermal heater wound around the peripheral wall portion of the box-shaped thermal conductor; a Peltier element in close contact with the bottom portion of the box-shaped thermal conductor; and a heat insulating layer covering the outer periphery of the box-shaped thermal conductor, the electrothermal heater, and the Peltier element. In a case of performing cooling, the Peltier element is energized to cool the box-shaped thermal conductor, and in a case of performing heating, the Peltier element is not energized and only the electrothermal heater is energized to heat the box-shaped thermal conductor by the electrothermal heater (for example, refer to Patent Literature 1).

Patent Literature 1: JP-A-Hei-11-316074

Incidentally, in a case where it is necessary to provide wet towels to many customers, cooling or heating a large number of wet towels simultaneously by a large-sized cold and hot storage is possible. However, in a case where an installation space is limited, it may be difficult to install the large-sized cold and hot storage. Also, in a case of heating the wet towel in the cold and hot storage described in Patent Literature 1, heating of the box-shaped thermal conductor is performed by an electrothermal heater wound around the peripheral wall portion of the box-shaped thermal conductor, and it takes a long time to heat the wet towel because the wet towel housed in the box-shaped thermal conductor is heated by natural convection and heat conduction of the air in the storage. In a case of cooling the wet towel in the cold and hot storage described in Patent Literature 1, the box-shaped thermal conductor is cooled by a Peltier element brought in close contact with the bottom portion of the box-shaped thermal conductor and whereby it takes a long time to cool the wet towel because the wet towel housed in the box-shaped thermal conductor is cooled by natural convection and heat conduction of the air in the storage.

In addition, the box-shaped thermal conductor is heated or cooled so as to heat or cool the wet towels housed in the box-shaped thermal conductor by natural convection and thermal conduction of the air in the storage. Therefore, although the wet towels housed at a position close to the inner wall portion of the box-shaped thermal conductor are heated or cooled in a short time, it takes a very long time to heat or cool the wet towels which are housed in the center portion of the box-shaped thermal conductor while being surrounded by other wet towels.

Therefore, it is desired to develop a cold and hot storage which can rapidly cool or heat all of the wet towels housed in the cold and hot storage without increasing the size of the cold and hot storage. In addition, even when the wet towels are capable of being rapidly cooled or heated, it is preferable that the power consumption is low.

Moreover, in the cold and hot storage described in Patent Literature 1, when cooling is performed, dew condensation occurs between the box-shaped thermal conductor and the heat insulating layer. As a result, the electrothermal heater rusts to disconnect the electrothermal heater, thereby failing to heat the wet towels. In such a case, the electrothermal heater wound around the peripheral wall portion of the box-shaped thermal conductor is covered with the heat insulating layer. Therefore, in order to repair the disconnection point of the electrothermal heater, the heat insulating layer covering the peripheral wall portion of the box-shaped thermal conductor needs to be removed. Accordingly, it is extremely difficult to repair the electrothermal heater.

BRIEF SUMMARY OF THE INVENTION

An object of the present invention is to provide a cold and hot storage capable of rapidly cooling or rapidly heating storage material with low power consumption.

A cold and hot storage of this invention includes: a main body portion including a door on a front surface; an inner tank arranged in the main body portion; a temperature control heat sink including a base plate and a plurality of fins formed on one surface of the base plate having the other surface arranged along a rear surface in the inner tank; a heater that heats the temperature control heat sink; a temperature control fan arranged on the one surface of the temperature control heat sink and blows air in the inner tank to the fins of the temperature control heat sink; a shielding plate that includes a plurality of through holes and a temperature control fan facing portion facing the temperature control fan and shields an area where the temperature control heat sink is arranged in a state that air blowing outlets are formed on upper and lower portions of the inner tank; a heat dissipation heat sink arranged outside the rear surface of the inner tank; a heat dissipation fan that blows air outside the inner tank to the heat dissipation heat sink; a Peltier module having a heat absorbing surface to be connected to the temperature control heat sink and a heat dissipating surface to be connected to the heat dissipation heat sink; and a power control unit that supplies power to the heater and the temperature control fan in a case of heating an inside of the inner tank and to the temperature control fan, the heat dissipation fan, and the Peltier module in a case of cooling the inside of the inner tank.

In the cold and hot storage of this invention, spaces communicating with the air blowing outlets are formed on both side portions of the temperature control heat sink.

The cold and hot storage of this invention includes a partition plate that partitions vertically an area where the temperature control heat sink is arranged on both sides of the temperature control fan facing portion of a surface of a side of the temperature control heat sink of the shielding plate.

The cold and hot storage of this invention includes: an outer panel and a rear panel configuring the main body portion; a partition formed between the rear panel of inner side of the outer panel and the inner tank; and an air guide that guides air between the rear panel and the partition to at least one opening of the rear panel, in which the rear panel includes an air intake port at a position facing the heat dissipation fan and at least one opening at an area extending in a width direction of the rear panel above the air intake port.

In the cold and hot storage of this invention, the air guide includes: a first air guide extending from a vicinity of a lower portion of one side portion of the heat dissipation heat sink toward one side of upper inner wall of the rear panel; and a second air guide extending from a vicinity of a lower portion of the other side portion of the heat dissipation heat sink toward the other side of upper inner wall of the rear panel.

A cold and hot storage of this invention includes: a main body portion including a door on a front surface; an inner tank arranged in the main body portion; a temperature control heat sink including a base plate and a plurality of fins formed on one surface of the base plate having the other surface arranged along a rear surface in the inner tank; a heater that heats the temperature control heat sink; a temperature control fan arranged on the one surface of the temperature control heat sink and blows air in the inner tank to the fins of the temperature control heat sink; a plate portion that is positioned on both sides of the temperature control fan and covers the upper portion of the plurality of fins; a heat dissipation heat sink arranged outside the rear surface of the inner tank; a heat dissipation fan that blows air outside the inner tank to the heat dissipation heat sink; a Peltier module having a heat absorbing surface to be connected to the temperature control heat sink and a heat dissipating surface to be connected to the heat dissipation heat sink; and a power control unit that supplies power to the heater and the temperature control fan in a case of heating an inside of the inner tank and to the temperature control fan, the heat dissipation fan, and the Peltier module in a case of cooling the inside of the inner tank.

In the cold and hot storage of this invention, the temperature control fan is arranged at the center of the one surface of the temperature control heat sink.

In the cold and hot storage of this invention, the heater is a plate-shaped sheet heater arranged in close contact with the other surface of the base plate.

In the cold and hot storage of this invention, the heater includes a heater wire and the heater wire is arranged in close contact with a base end portion of the fins between the fins.

In the cold and hot storage of this invention, the fin is a plate-shaped fin extending toward an inner wall on both sides of the inner tank.

In the cold and hot storage of this invention, the fin is a plate-shaped fin having a predetermined length and a plurality of the fin is arranged at predetermined intervals in a vertical direction and a lateral direction.

In the cold and hot storage of this invention, the fin is a plate-shaped fin extending radially from the center portion of the temperature control heat sink.

In the cold and hot storage of this invention, the temperature control fan blows air in the inner tank to the plurality of fins of the temperature control heat sink and circulates the air in the inner tank through a groove formed between the plurality of fins.

A cold and hot storage of this invention includes: a main body portion including a door on a front surface; an inner tank arranged in the main body portion; a temperature control heat sink arranged near a rear surface in the inner tank; a heater that heats the temperature control heat sink; a temperature control fan arranged on a front surface of the temperature control heat sink and blows air in the inner tank to the front surface of the temperature control heat sink; a heat dissipation heat sink arranged outside the rear surface of the inner tank; a heat dissipation fan that blows air outside the inner tank to the heat dissipation heat sink; a Peltier module having a heat absorbing surface to be connected to the temperature control heat sink and a heat dissipating surface to be connected to the heat dissipation heat sink; and a power control unit that supplies power to the heater and the temperature control fan in a case of heating an inside of the inner tank and to the temperature control fan, the heat dissipation fan, and the Peltier module in a case of cooling the inside of the inner tank.

The cold and hot storage of this invention includes: an outer panel and a rear panel configuring the main body portion; a partition formed between the rear panel of inner side of the outer panel and the inner tank; and an air guide that guides air between the rear panel and the partition to at least one opening of the rear panel, in which the rear panel includes an air intake port at a position facing the heat dissipation fan and at least one opening at an area extending in a width direction of the rear panel above the air intake port.

In the cold and hot storage of this invention, the air guide includes: a first air guide extending from a vicinity of a lower portion of one side portion of the heat dissipation heat sink toward one side of upper inner wall of the rear panel; and a second air guide extending from a vicinity of a lower portion of the other side portion of the heat dissipation heat sink toward the other side of upper inner wall of the rear panel.

In the cold and hot storage of this invention, the inner tank houses a wet towel and heats or cools the wet towel.

According to the present invention, the storage material can be rapidly cooled or rapidly heated with low power consumption.

DETAILED DESCRIPTION

Figure 1:
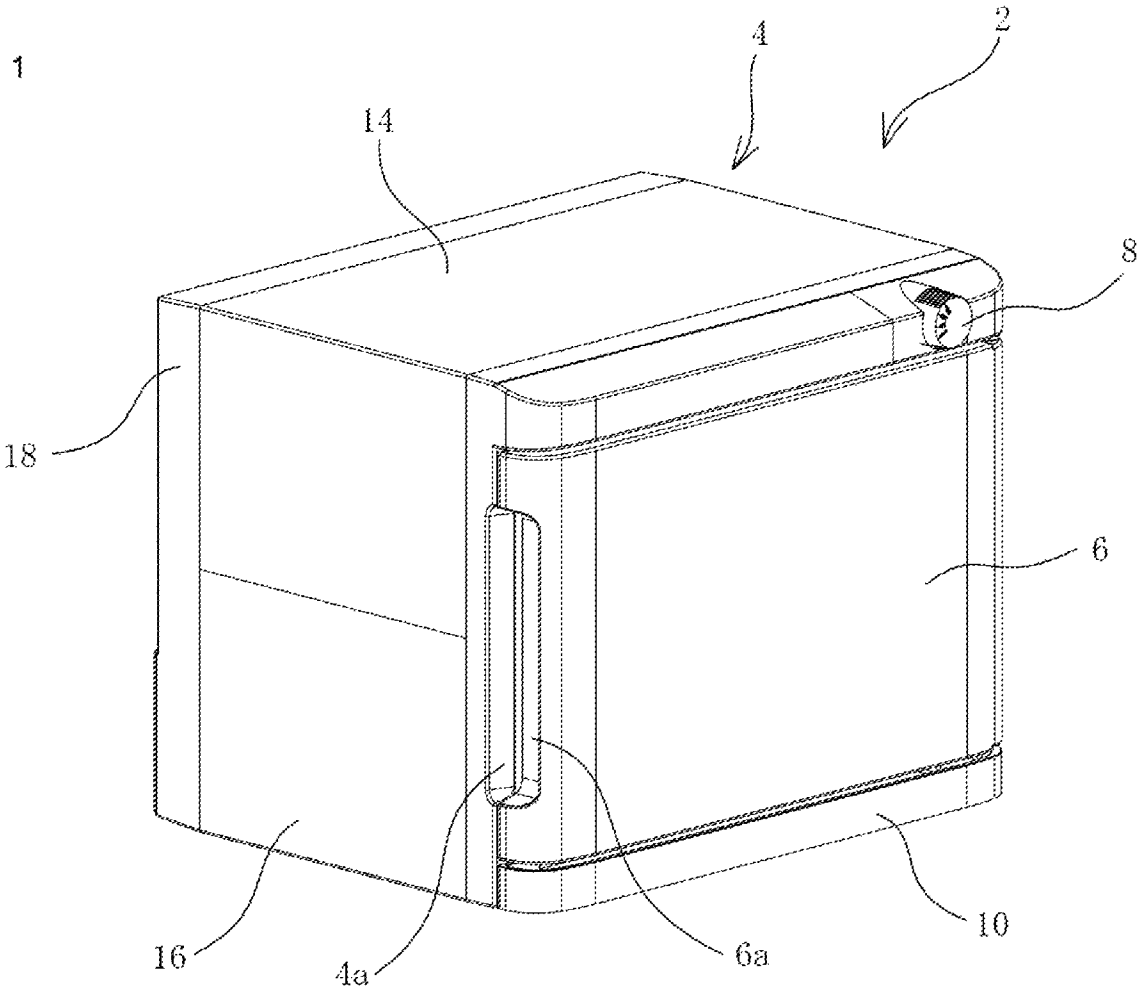
FIG. 1 is a perspective view illustrating a cold and hot storage with a door closed according to a first embodiment.
Figure 2:
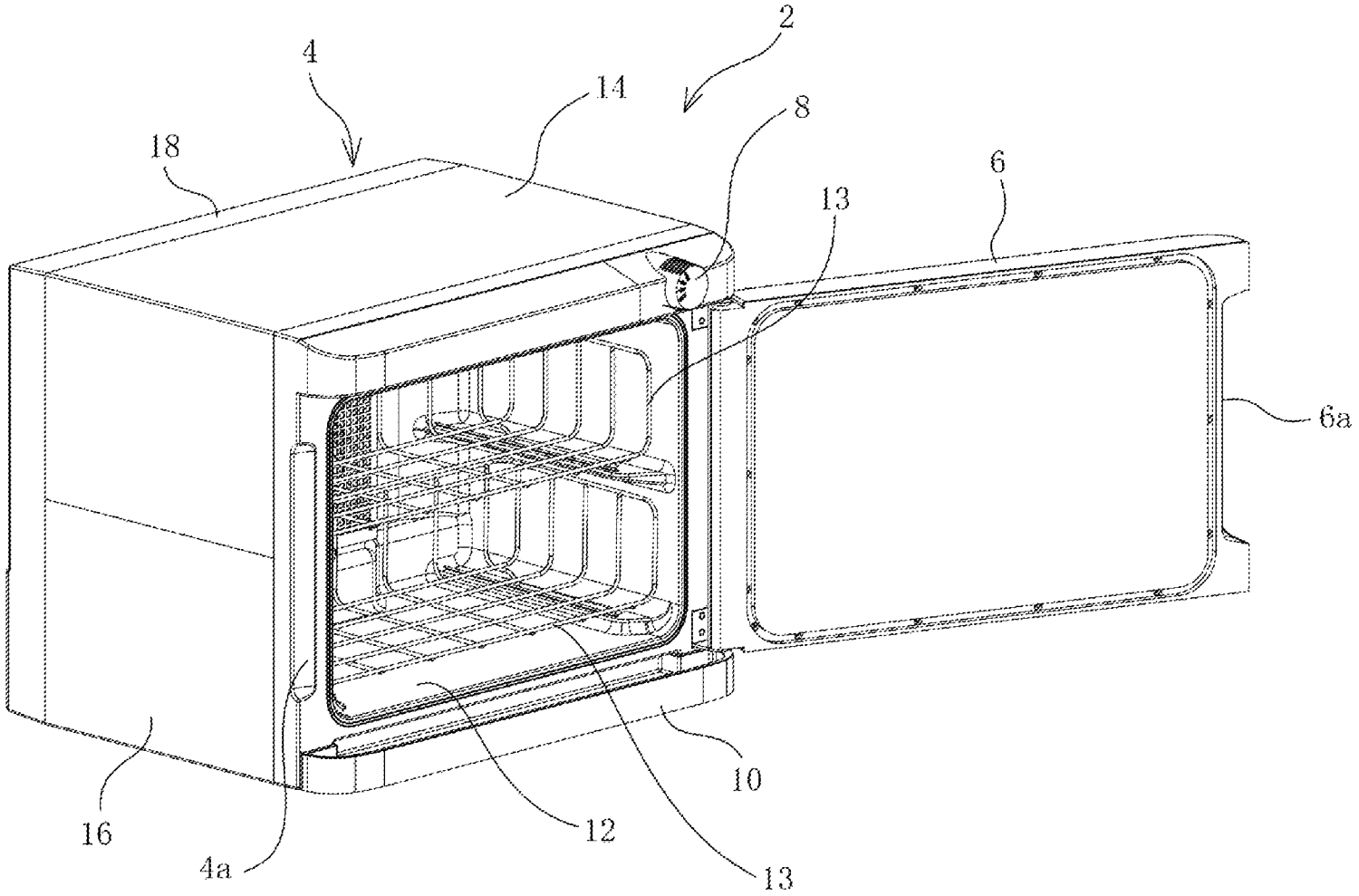
FIG. 2 is a perspective view illustrating the cold and hot storage with the door opened according to the first embodiment.

Hereinafter, a cold and hot storage according to embodiments of the present invention will be described with reference to the drawings. FIG. 1 is a perspective view illustrating the cold and hot storage with a door closed according to a first embodiment. FIG. 2 is a perspective view illustrating the cold and hot storage with the door opened according to the first embodiment. The cold and hot storage 2 includes a box-shaped main body portion 4 and a door 6 provided on the front surface of the main body portion 4. An inner tank 12 for housing a wet towel and the like is installed in the main body portion 4, and a cage 13 on which the wet towel is placed is installed in the inner tank 12. In addition, in the inner tank 12, a temperature sensor 49 (refer to FIG. 7) for detecting the temperature in the inner tank 12 is provided. The inner tank 12 is covered with an upper cover 14, a lower cover 16 (the upper cover 14 and the lower cover 16 constitute an outer panel) and a rear panel 18. Note that a rear surface portion partition 19 (refer to FIG. 6) is provided between the inner tank 12 and the rear panel 18. Here, a heat insulating material (not illustrated) such as urethane foam is arranged between the inner tank 12 and the upper cover 14, the lower cover 16, and the rear surface portion partition 19.

An operation dial 8 for setting the temperature for cooling or heating is provided on the upper right front portion of the main body portion 4, and a dew receiving tray 10 is provided at the lower front portion of the main body portion 4. Also, an opening 41 (refer to FIG. 6) for dissipating heat by a heat dissipation unit 22 (refer to FIG. 3) is formed at the rear panel 18. Here, the inner tank 12, the upper cover 14, the lower cover 16, the rear panel 18, the rear surface portion partition 19, the door 6, and the dew receiving tray 10 constituting the main body portion 4 are formed from thermally low conductive polypropylene from the viewpoint of heat resistance and chemical resistance.

The right side edge portion of the door 6 is attached to the right side edge portion of the front surface of the main body portion 4 so as to rotate freely. On the left side edge portion of the door 6, a handle 6*a* for hooking a finger in the case of opening the door 6 is formed along the left side edge portion of the door 6. In addition, at a position facing the handle 6*a* of the left side edge portion of the front surface of the main body portion 4, a recess 4*a* for allowing the finger to easily hook the handle 6*a* is formed.

Figure 3:
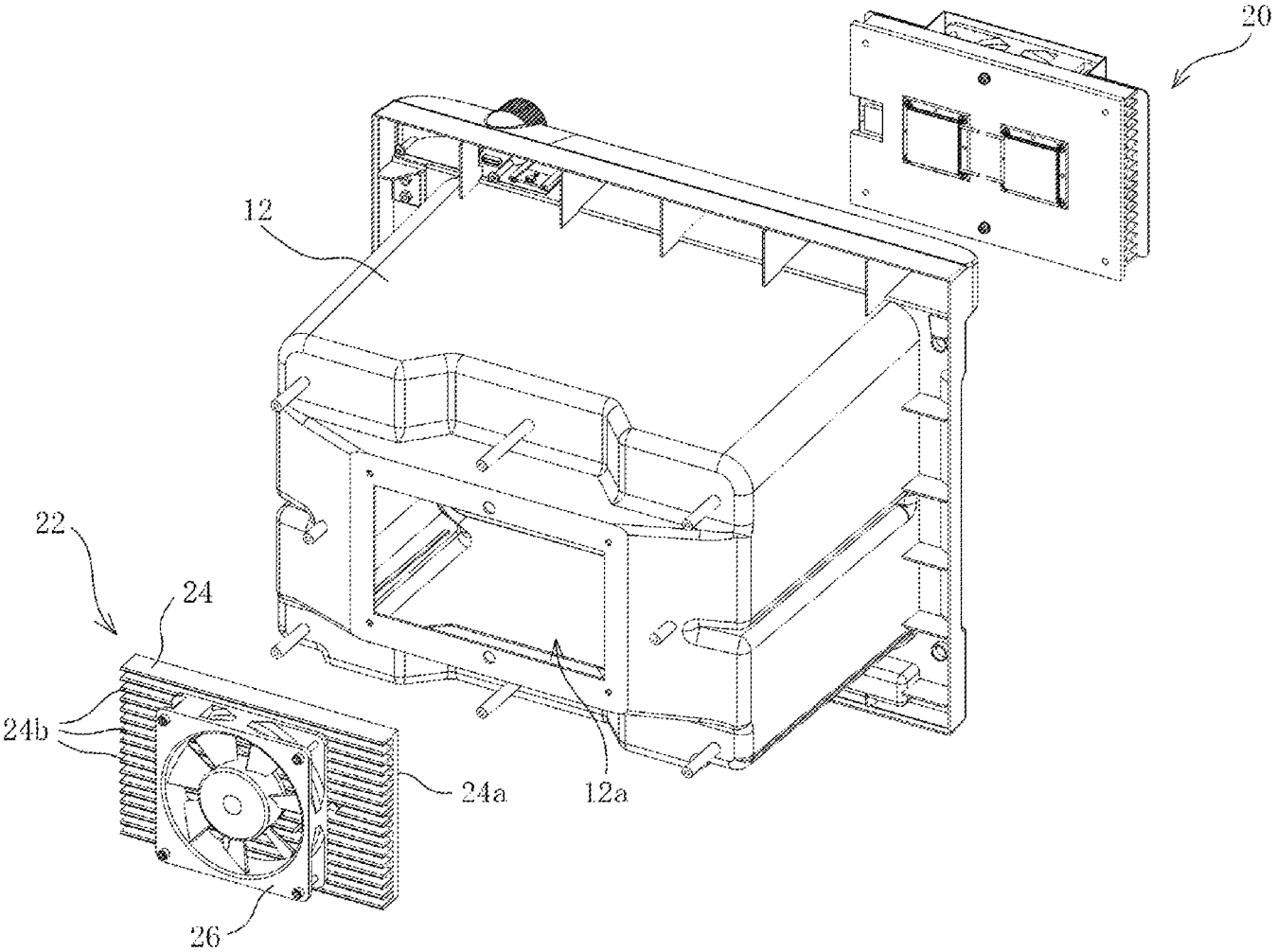
FIG. 3 is a view illustrating a temperature control unit and a heat dissipation unit attached to an inner tank according to the first embodiment.

FIG. 3 is a view illustrating a temperature control unit and the heat dissipation unit attached to the inner tank according to the first embodiment. An opening 12*a* is formed on the rear surface of the inner tank 12. A temperature control unit 20 and the heat dissipation unit 22 are arranged so as to face the opening 12*a* from the inside and the outside of the inner tank 12. To be specific, the temperature control unit 20 is arranged along the rear surface in the inner tank 12 so as to face the opening 12*a*. Moreover, the heat dissipation unit 22 is arranged outside the rear surface of the inner tank 12 so as to face the opening 12*a*.

The heat dissipation unit 22 includes a heat dissipation heat sink 24 formed of a metal having high thermal conductivity such as aluminum and a heat dissipation fan 26. The heat dissipation heat sink 24 includes a base plate 24*a* having a rectangular plate shape and a plurality of plate-shaped fins 24*b* formed at predetermined intervals on one surface of the base plate 24*a*. The other surface of the heat dissipation heat sink 24, on which the fins 24*b* are not formed, is fixed to the outside of the rear surface of the inner tank 12. The heat dissipation fan 26 is fixed to the center portion of the heat dissipation heat sink 24 at a position facing the fins 24*b*.

Figure 4:
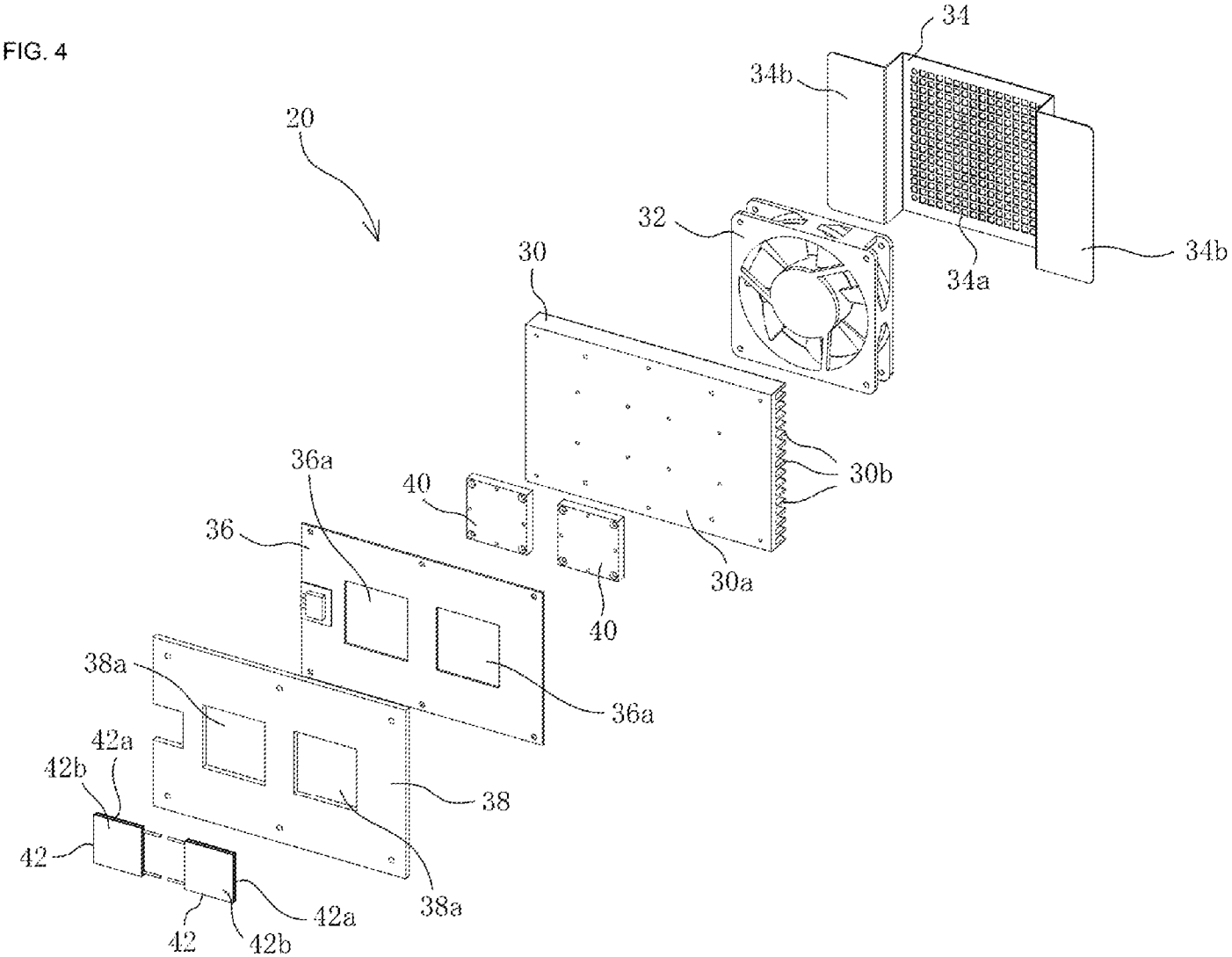
FIG. 4 is a view illustrating a configuration of the temperature control unit according to the first embodiment.

FIG. 4 is a view illustrating a configuration of the temperature control unit according to the first embodiment. The temperature control unit 20 includes a temperature control heat sink 30, a temperature control fan 32, a temperature control fan cover 34, a silicone rubber heater 36 which is a sheet heater, a heat insulating plate 38, a Peltier spacer 40, and a Peltier module 42.

Figure 5:
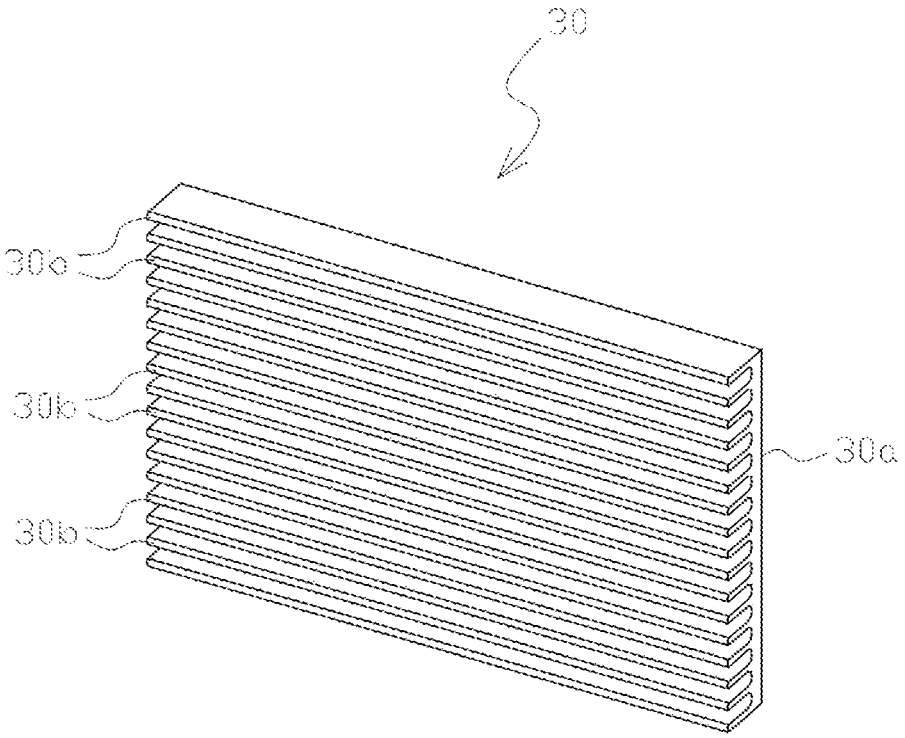
FIG. 5 is a view illustrating a configuration of a temperature control heat sink according to the first embodiment.

FIG. 5 is a view illustrating a configuration of the temperature control heat sink. The temperature control heat sink 30 includes a metal with high thermal conductivity, such as aluminum and includes a base plate 30*a* having a rectangular plate shape and a plurality of plate-shaped fins 30*b* formed on one surface of the base plate 30*a* at predetermined intervals. In the inner tank 12, this temperature control heat sink 30 is arranged such that the fins 30*b* face the inside of the inner tank 12 and the fins 30*b* extend toward the inner walls on both sides of the inner tank 12.

The temperature control fan 32 is fixed at the center portion of the temperature control heat sink 30 so as to face the fins 30*b*. The temperature control fan cover 34 is constituted by a cover portion 34*a* covering the temperature control fan 32 and a plate portion 34*b* formed on both sides of the cover portion 34*a*. A mesh for feeding the air in the inner tank 12 to the temperature control fan 32 is formed at the cover portion 34*a*. The temperature control fan cover 34 is fixed to the temperature control heat sink 30 in a state in which the cover portion 34*a* covers the temperature control fan 32 and the plate portion 34*b* covers the upper portion of the fin 30*b* of the temperature control heat sink 30 that is positioned on both sides of the temperature control fan 32.

The silicone rubber heater 36 has a rectangular plate shape having substantially the same size as the base plate 30*a* of the temperature control heat sink 30. Two openings 36*a* are formed so as to be axially symmetric with respect to the center in the width direction of the silicone rubber heater 36. The silicone rubber heater 36 is superimposed and fixed in close contact with the other surface of the base plate 30*a* of the temperature control heat sink 30, on which the fins 30*b* are not formed.

The heat insulating plate 38 has substantially the same shape as the silicone rubber heater 36. To be specific, the heat insulating plate 38 has a rectangular plate shape and two openings 38*a* having substantially the same size as the openings 36*a* of the silicone rubber heater 36. The two openings 38*a* are formed so as to be axially symmetric with respect to the center in the width direction of the heat insulating plate 38. The heat insulating plate 38 is superimposed and fixed to a surface which is not in close contact with the base plate 30*a* of the silicone rubber heater 36.

The Peltier spacer 40 includes a metal having high thermal conductivity, such as aluminum and has a rectangular plate shape. The temperature control unit 20 includes the two Peltier spacers. The Peltier spacers 40 are fixed in close contact with the base plate 30*a* in the two openings formed by the openings 36*a* of the silicone rubber heater 36 and the openings 38*a* of the heat insulating plate 38 while the silicone rubber heater 36 and the heat insulating plate 38 are superimposed on the temperature control heat sink 30.

The Peltier module 42 includes a heat absorbing surface 42*a* that absorbs heat and a heat dissipating surface 42*b* that dissipates heat when a predetermined voltage is applied. The temperature control unit 20 includes the two Peltier modules 42. The heat absorbing surfaces 42*a* of the Peltier modules 42 are fixed on the Peltier spacers 40 so as to be in close contact with surfaces of the Peltier spacers 40 on which the temperature control heat sink 30 of the Peltier spacers 40 is not fixed.

Figure 6:
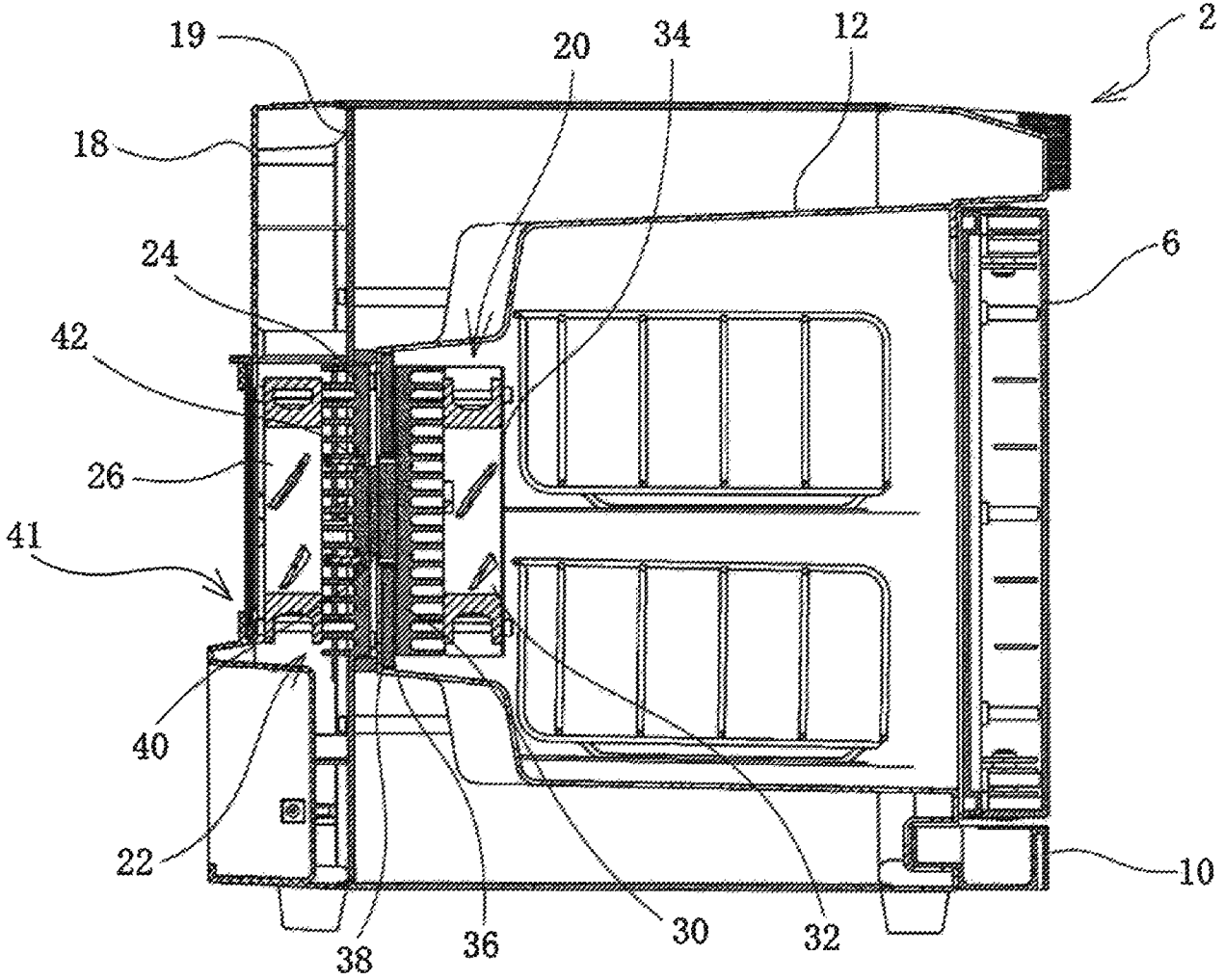
FIG. 6 is a cross-sectional view in a front-back direction at the position where a Peltier module of the cold and hot storage according to the first embodiment is arranged.

FIG. 6 is a cross-sectional view in a front-back direction at the position where the Peltier module of the cold and hot storage according to the first embodiment is arranged. As illustrated in FIG. 6, the temperature control unit 20 is arranged inside the inner tank 12 and the heat dissipation unit 22 is arranged outside the inner tank 12 at the opening 12*a* of the inner tank 12 of the cold and hot storage 2. To be specific, in the temperature control unit 20, the heat insulating plate 38 is brought into close contact with the rear surface in the inner tank 12, and the Peltier module 42 fixed to the Peltier spacer 40 is fixed so as to be positioned outside the inner tank 12. In addition, the heat dissipation unit 22 is fixed so that the other surface of the base plate 24*a* of the heat dissipation heat sink 24 is in close contact with the heat dissipating surface 42*b* of the Peltier module 42.

Figure 7:
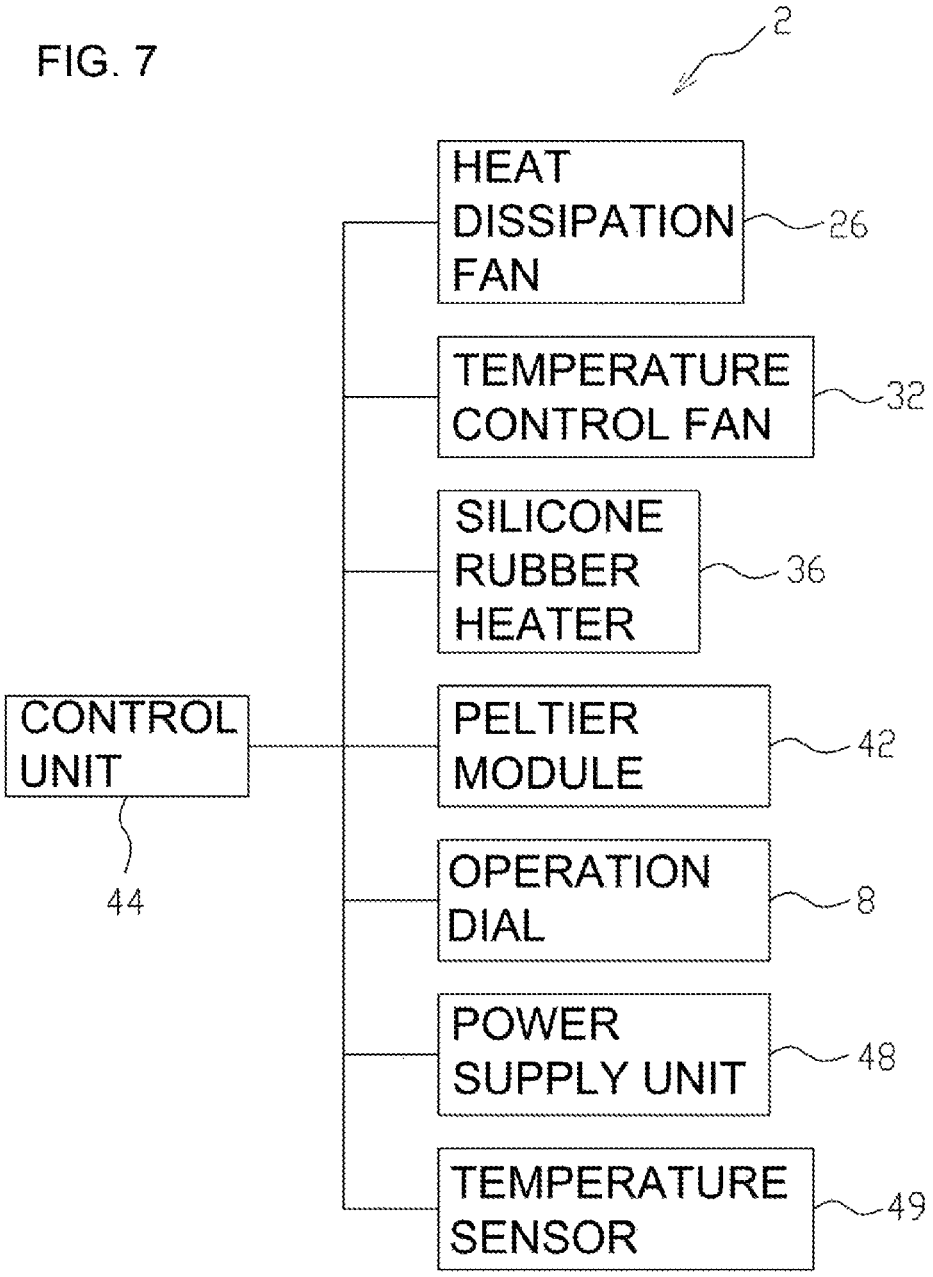
FIG. 7 is a block diagram illustrating a system configuration of the cold and hot storage according to the first embodiment.

FIG. 7 is a block diagram illustrating a system configuration of the cold and hot storage 2 according to the first embodiment. The cold and hot storage 2 includes a control unit 44 which comprehensively controls the whole of the cold and hot storage 2. To the control unit 44, the heat dissipation fan 26, the temperature control fan 32, the silicone rubber heater 36, the Peltier module 42, the operation dial 8, a power supply unit 48, and a temperature sensor 49 are connected. The power supply unit 48 supplies power to each unit of the cold and hot storage 2.

Next, a process of cooling the inside of the inner tank 12 of the cold and hot storage 2 according to the first embodiment will be described. When the temperature for cooling is set by operating the operation dial 8, the control unit 44 supplies power to the heat dissipation fan 26, the temperature control fan 32, and the Peltier module 42 by the power supply unit 48 in order to cool the inside of the inner tank 12. As a result, the temperature control heat sink 30 is cooled by the Peltier module 42 via the Peltier spacer 40. Also, the air in the inner tank 12 is blown to the center portion of the temperature control heat sink 30 by the temperature control fan 32 and flows toward the inner wall on both sides of the inner tank 12 through an air passage formed by the plurality of fins 30*b* and the plate portion 34*b* of the temperature control fan cover 34 that covers the upper portion of the fins 30*b*. The air is cooled while flowing and the cooled air flows toward the door 6 i.e., flows toward the front of the cold and hot storage 2, along the inner wall on both sides. Moreover, the air goes around the front surface of the wet towels housed in the inner tank 12. Then, the air passes over and under the wet towels and through the wet towels, and reaches the temperature control fan 32, and again, the air is blown to the center portion of the temperature control heat sink 30 by the temperature control fan 32. Therefore, the cooled air circulating in the inner tank 12 which flows along the inner wall on both sides of the inner tank 12 to the side of the front surface in the inner tank 12 causes the wet towels housed in the inner tank 12 to be efficiently and rapidly cooled.

In addition, power supply to the Peltier module 42 or the like by the power supply unit 48 is feedback-controlled by using the temperature in the inner tank 12 detected by the temperature sensor 49 so that the temperature in the inner tank 12 becomes the temperature set by the operation dial 8. Therefore, power consumption can be reduced.

In addition, heat generated at the heat dissipating surface 42*b* of the Peltier module 42 is transmitted to the heat dissipation heat sink 24. Moreover, heat is efficiently dissipated from the heat dissipation heat sink 24 by blowing air outside the cold and hot storage 2 to the heat dissipation heat sink 24 by the heat dissipation fan 26.

Next, a process of heating the inside of the inner tank 12 of the cold and hot storage 2 according to the first embodiment will be described. When the temperature for heating is set by operating the operation dial 8, the control unit 44 supplies power to the silicone rubber heater 36 and the temperature control fan 32 by the power supply unit 48 in order to heat the inside of the inner tank 12. As a result, the temperature control heat sink 30 is heated by the silicone rubber heater 36. Also, the air in the inner tank 12 is blown to the center portion of the temperature control heat sink 30 by the temperature control fan 32 and flows toward the inner wall on both sides of the inner tank 12 through an air passage formed by the plurality of fins 30*b* and the plate portion 34*b* of the temperature control fan cover 34 that covers the upper portion of the fins 30*b*. The air is heated while flowing and the heated air flows toward the door 6 along the inner wall on both sides, i.e., flows toward the front in the cold and hot storage 2. Moreover, the air goes around the front surface of the wet towels housed in the inner tank 12. Then, the air passes over and under the wet towels and through the wet towels, and reaches the temperature control fan 32, and again, the air is blown to the center portion of the temperature control heat sink 30 by the temperature control fan 32. Therefore, the heated air circulating in the inner tank 12 which flows along the inner wall on both sides of the inner tank 12 to the side of the front surface in the inner tank 12 causes the wet towels housed in the inner tank 12 to be efficiently and rapidly heated.

In addition, power supply to the silicone rubber heater 36 or the like by the power supply unit 48 is feedback-controlled by using the temperature in the inner tank 12 detected by the temperature sensor 49 so that the temperature in the inner tank 12 becomes the temperature set by the operation dial 8. Therefore, power consumption can be reduced.

According to the cold and hot storage 2 of this first embodiment, when cooling the inside of the inner tank 12 of the cold and hot storage 2, by blowing air in the inner tank 12 to the cooled temperature control heat sink 30, the air in the inner tank 12 is cooled, and the cooled air flows to the inner tank 12 in the front direction from the rear surface side in the inner tank 12, along the inner walls on both sides of the inner tank 12 to circulate the cooled air in the inner tank 12. Therefore, the inside of the inner tank 12 can be highly efficiently cooled and all the wet towels housed in the inner tank 12 can be rapidly cooled with low power consumption. Also, because the air in the inner tank 12 is circulated, it is possible to suppress the occurrence of dew condensation in the inner tank 12 and to suppress the lowering of the cooling efficiency.

Also, when heating the inside of the inner tank 12 of the cold and hot storage 2, by blowing air in the inner tank 12 to the heated temperature control heat sink 30, the air in the inner tank 12 is heated, and the heated air is flowed to the inner tank 12 in the front direction from the rear surface side in the inner tank 12, along the inner walls on both sides of the inner tank 12 to circulate the heated air in the inner tank 12. Therefore, the inside of the inner tank 12 can be highly efficiently heated and all the wet towels housed in the inner tank 12 can be rapidly heated with low power consumption.

In addition, because the silicone rubber heater 36 is superimposed and fixed so as to be in close contact with the temperature control heat sink 30, there is no possibility that the inside of the inner tank cannot be heated due to disconnection from rusting of an electrothermal heater included in an inner tank because of dew condensation as described in Patent Literature 1 mentioned above. Therefore, heating the inside of the inner tank 12 can be performed stably.

Next, a cold and hot storage according to a second embodiment will be described. In the cold and hot storage according to the second embodiment, the temperature control fan cover 34 of the cold and hot storage 2 according to the first embodiment is changed to a shielding plate 60. Other points are the same as the configuration of the cold and hot storage 2 according to the first embodiment. Therefore, the cold and hot storage 50 according to the second embodiment will be described while the same reference signs as those used in the description of the cold and hot storage 2 according to the first embodiment are given to the same configuration as that of the cold and hot storage 2 according to the first embodiment.

Figure 8:
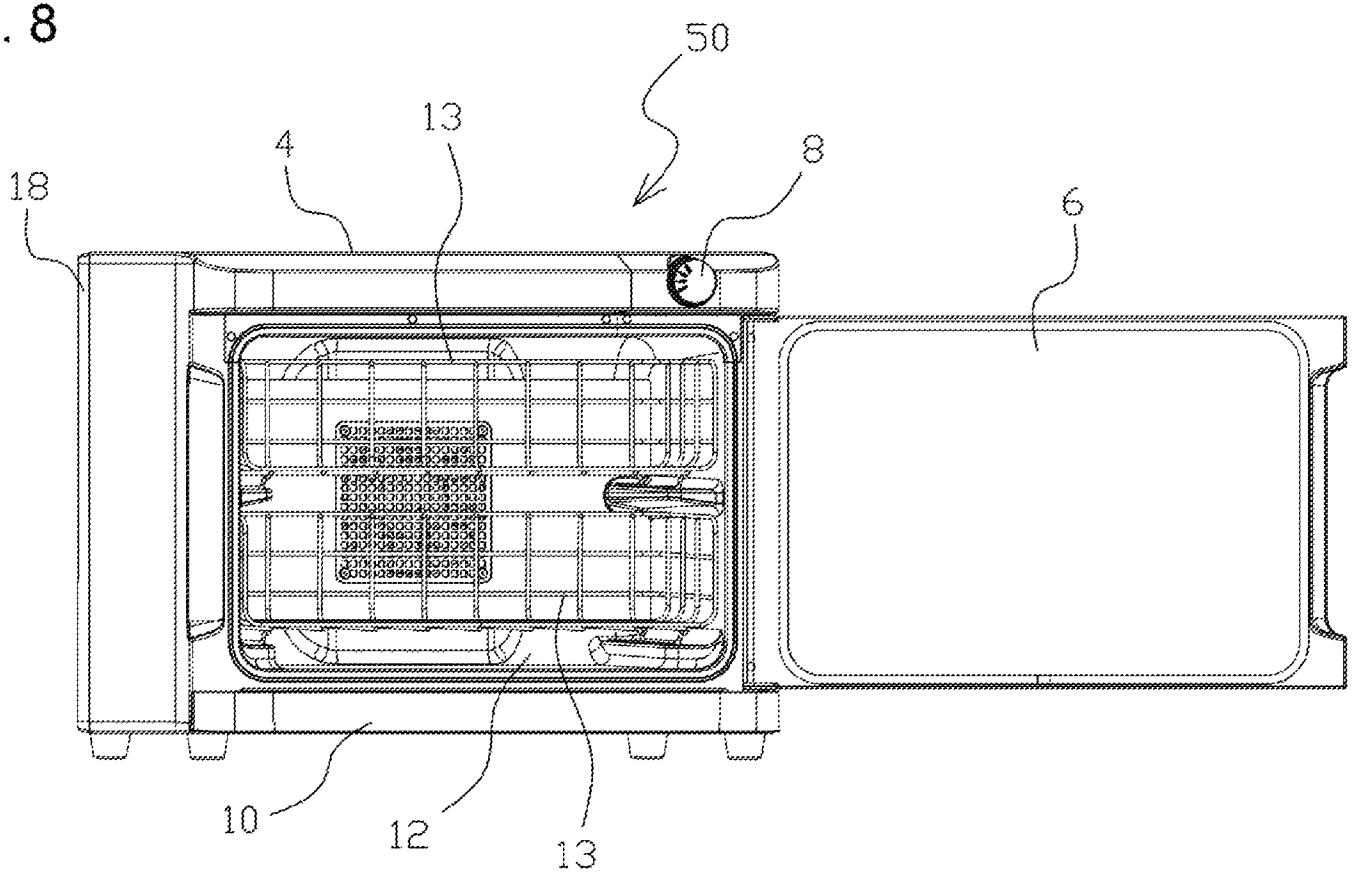
FIG. 8 is a perspective view illustrating a cold and hot storage with a door opened according to a second embodiment.
Figure 9:
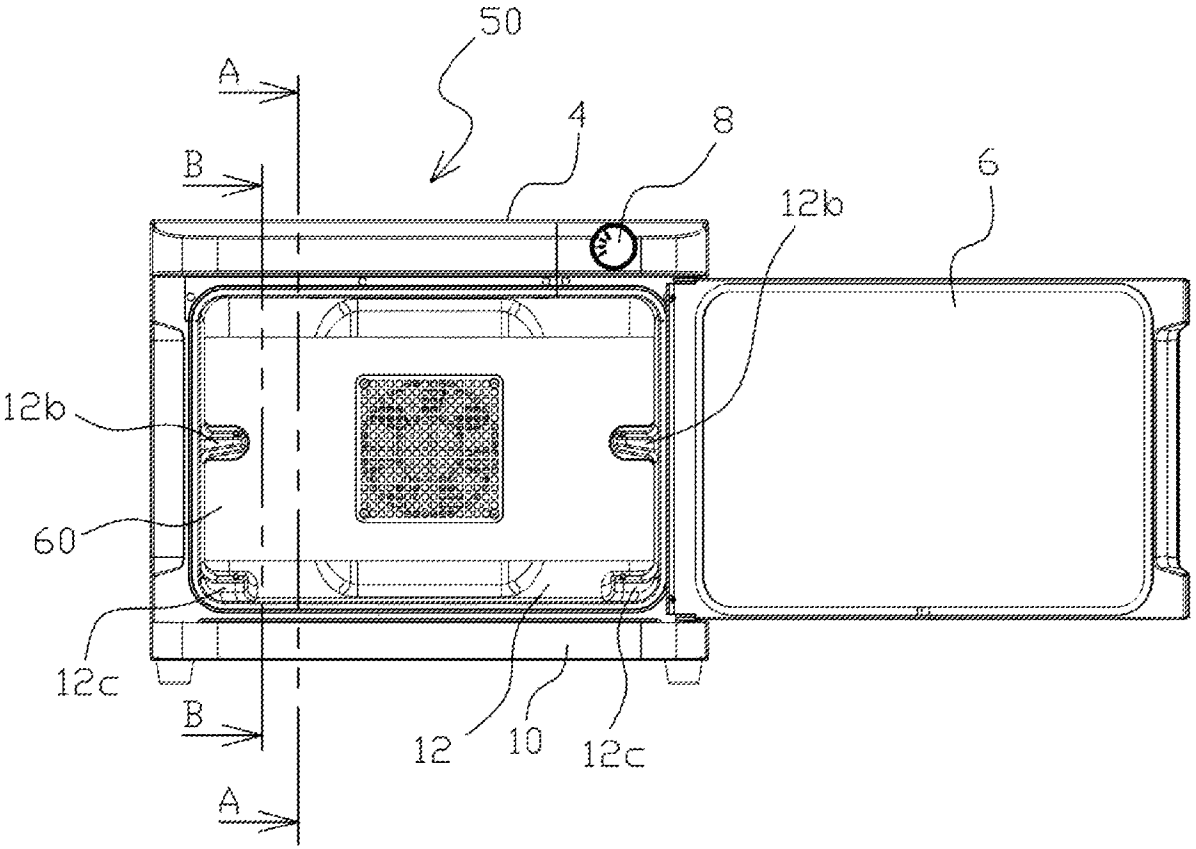
FIG. 9 is a front elevation view illustrating the cold and hot storage with the door opened and a cage in an inner tank removed according to the second embodiment.

FIG. 8 is a perspective view illustrating the cold and hot storage 50 with a door opened according to the second embodiment. FIG. 9 is a front elevation view illustrating the cold and hot storage 50 with the door 6 opened and a cage 13 in an inner tank 12 removed according to the second embodiment. The cold and hot storage 50 includes a box-shaped main body portion 4 and the door 6 provided on the front surface of the main body portion 4. An inner tank 12 for housing a wet towel and the like is installed in the main body portion 4, and a cage 13 on which the wet towel is placed is installed in the inner tank 12. Here, a placing portion 12*b* for placing the cage 13 to be installed at an upper stage is formed on an inner side wall on both sides of the inner tank 12, and a placing portion 12*c* for placing the cage 13 to be installed at a lower stage is also formed. An operation dial 8 for setting the temperature for cooling or heating is provided on the upper right front portion of the main body portion 4, and a dew receiving tray 10 is provided at the lower front portion of the main body portion 4.

Figure 10:
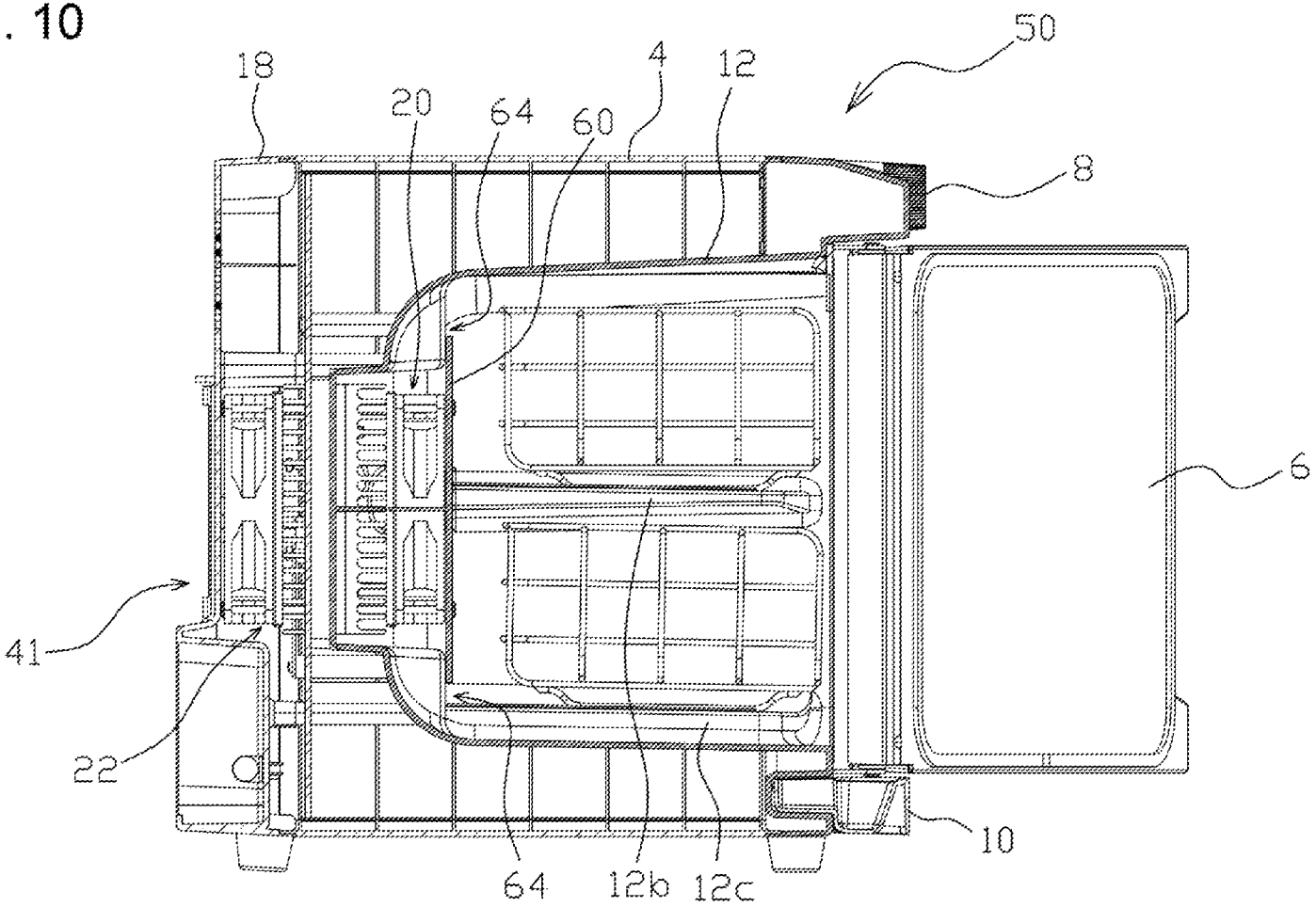
FIG. 10 is a cross-sectional view (A-A cross section in FIG. 9) of the cold and hot storage according to the second embodiment.

FIG. 10 is an A-A cross-sectional view in FIG. 9 of the cold and hot storage 50 according to the second embodiment. An opening 41 for dissipating heat by a heat dissipation unit 22 (refer to FIG. 3) is formed at the rear panel 18 of the main body portion 4. In addition, an opening 12*a* (refer to FIG. 3) is formed on a rear surface of the inner tank 12. A temperature control unit 20 and the heat dissipation unit 22 are arranged so as to face the opening 12*a* from the inside and the outside of the inner tank 12. To be specific, the temperature control unit 20 is arranged along the rear surface in the inner tank 12 so as to face the opening 12*a*. Moreover, the heat dissipation unit 22 is arranged outside the rear surface of the inner tank 12 so as to face the opening 12*a*.

Figure 11:
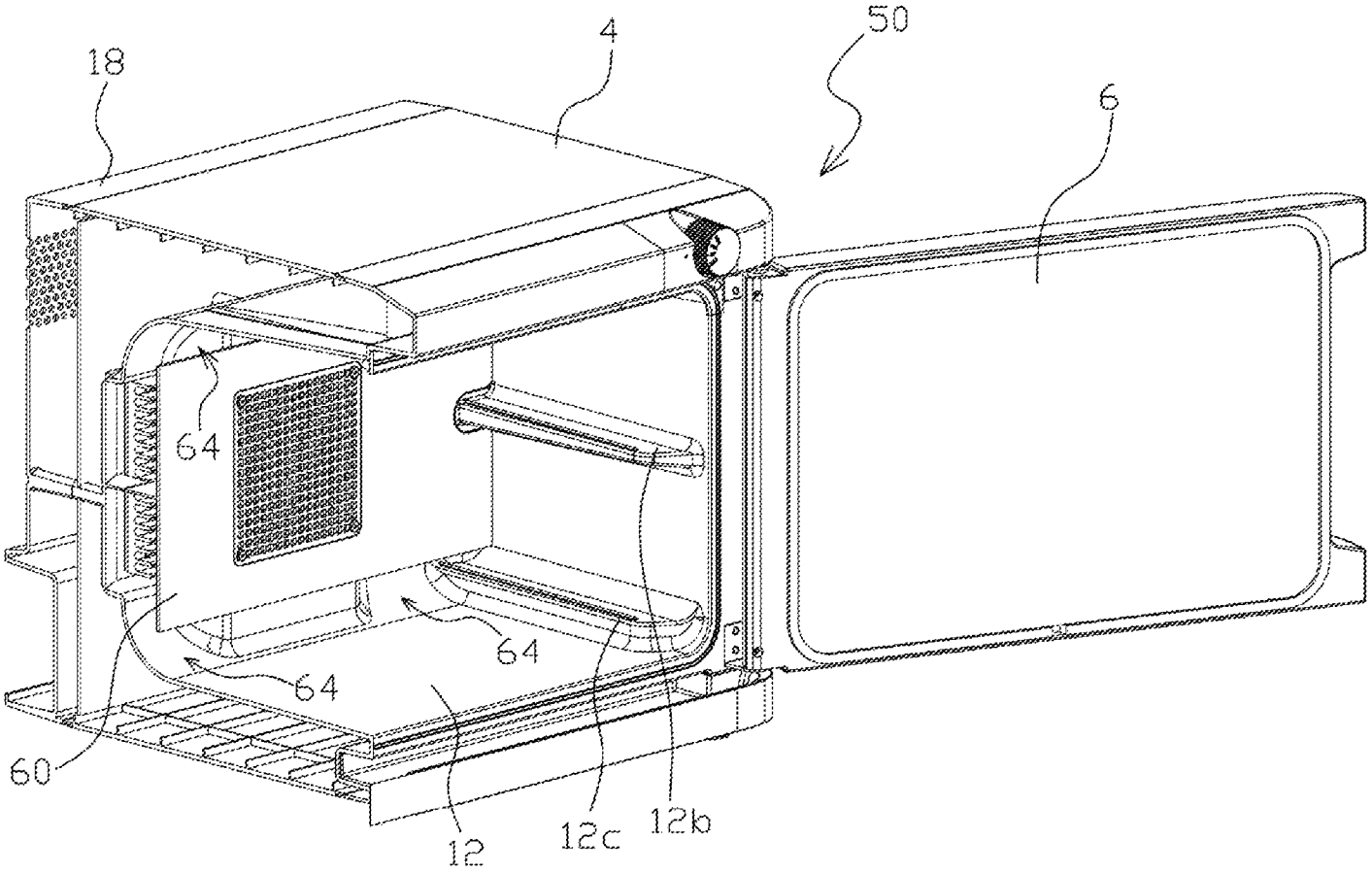
FIG. 11 is a sectional perspective view (B-B cross section in FIG. 9) of the cold and hot storage according to the second embodiment.
Figure 12:
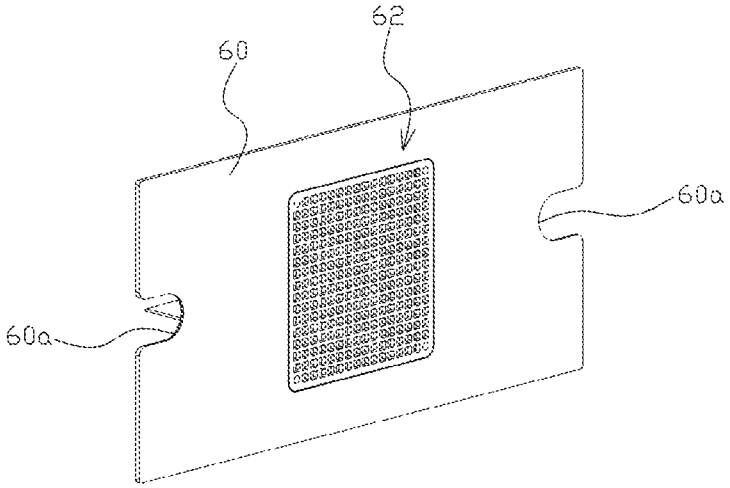
FIG. 12 is a front perspective view of a shielding plate according to the second embodiment.
Figure 13:
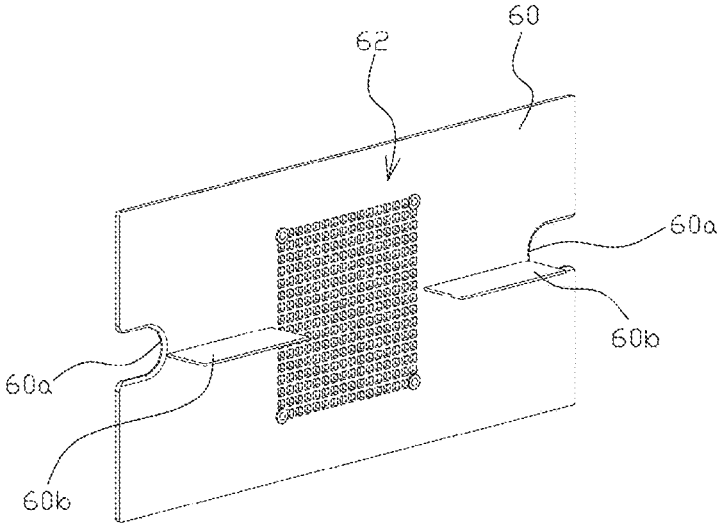
FIG. 13 is a rear perspective view of the shielding plate according to the second embodiment.

FIG. 11 is a B-B sectional perspective view in FIG. 9 of the cold and hot storage 50 according to the second embodiment. As illustrated in a front perspective view of FIG. 12 and a rear perspective view of FIG. 13, a shielding plate 60 has a plate shape, and the center portion at which a temperature control fan facing portion 62 including a plurality of through holes for feeding air in the inner tank 12 to a temperature control fan 32 is formed. The shielding plate 60 is arranged on a front surface side of a temperature control heat sink 30 in a state where the temperature control fan facing portion 62 faces the temperature control fan 32 and shields the area where the temperature control heat sink 30 is arranged in a state where air blowing outlets 64 are formed at top and bottom of both side portions of the inner tank 12. To be specific, a depression 60*a* having a U-shape is formed on the shielding plate 60 at the center portion in the vertical direction on both side portions, and the shielding plate 60 is arranged on the front surface side of the temperature control heat sink 30 in a state where a placing portion 12*a* is positioned in the depression 60*a* and both side portions of the shielding plate 60 are in contact with inner side walls on both sides of the inner tank 12. In this case, the upper portion and the lower portion on the rear surface side of the temperature control fan facing portion 62 provided on the shielding plate 60 are in contact with the inner wall of the inner tank 12 at the upper portion and the lower portion of the opening 12*a* formed in the inner tank 12. Therefore, the air blowing outlets 64 are formed at upper and lower portions of both side portions of the inner tank 12. Also, spaces communicating with the air blowing outlets 64 are formed on both side portions of the temperature control heat sink 30. Moreover, a partition plate 60*b* for vertically partitioning an area where the temperature control heat sink 30 is arranged is provided on both sides of the temperature control fan facing portion 62 on the back surface side of the shielding plate 60.

Next, a process of cooling the inside of the inner tank 12 of the cold and hot storage 50 according to the second embodiment will be described. When the temperature for cooling is set by operating the operation dial 8, the control unit 44 supplies power to the heat dissipation fan 26, the temperature control fan 32, and the Peltier module 42 by the power supply unit 48 in order to cool the inside of the inner tank 12. As a result, the temperature control heat sink 30 is cooled by the Peltier module 42 via the Peltier spacer 40.

Also, air in the inner tank 12 is blown to the center portion of the temperature control heat sink 30 by the temperature control fan 32 and in the space shielded by the shielding plate 60, the air flows along the plurality of fins 30*b* of the temperature control heat sink 30 toward the end portions on both sides of the temperature control heat sink 30. The air is cooled while flowing and the cooled air passes through the spaces formed on the both side portions of the temperature control heat sink 30 and is blown out from the air blowing outlets 64 into the inner tank 12.

The air blown out from the air blowing outlets 64 formed at the upper portion of the inner tank 12 flows toward the door 6, i.e., front of the cold and hot storage 50, along the upper surface and side surfaces of the wet towels housed in the cage 13 installed at an upper stage in the inner tank 12. Moreover, the air goes around the front surface of the wet towels. Then, the air passes the lower surface of the wet towels housed in the cage 13 installed at the upper stage and through the wet towels, and reaches the temperature control fan 32, and again, the air is blown to the center portion of the temperature control heat sink 30 by the temperature control fan 32.

In addition, the air blown out from the air blowing outlets 64 formed at the lower portion of the inner tank 12 flows toward the door 6, i.e., toward the front of the cold and hot storage 50, along the lower surface and side surfaces of the wet towels housed in the cage 13 installed at a lower stage of the inner tank 12. Moreover, the air goes around the front surface of the wet towels. Then, the air passes the upper surface of the wet towels housed in the cage 13 installed at the lower stage and between the wet towels, and reaches the temperature control fan 32, and again, the air is blown to the center portion of the temperature control heat sink 30 by the temperature control fan 32. Therefore, the cooled air circulating in the inner tank 12 which flows along the upper portion, the lower portion, and the inner wall on both sides of the inner tank 12 to the side of the front surface in the inner tank 12 causes the wet towels housed in the inner tank 12 to be efficiently and rapidly cooled. Also, because the air flowing from the front surface side in the inner tank 12 toward the temperature control fan 32 passes between the wet towels, a wet towel surrounded by other wet towels is also efficiently and rapidly cooled.

In addition, power supply to the Peltier module 42 or the like by the power supply unit 48 is feedback-controlled by using the temperature in the inner tank 12 detected by the temperature sensor 49 so that the temperature in the inner tank 12 becomes the temperature set by the operation dial 8. Therefore, power consumption can be reduced.

In addition, heat generated at the heat dissipating surface 42*b* of the Peltier module 42 is transmitted to the heat dissipation heat sink 24. Moreover, heat is efficiently dissipated from the heat dissipation heat sink 24 by blowing air outside the cold and hot storage 50 to the heat dissipation heat sink 24 by the heat dissipation fan 26.

Next, a process of heating the inside of the inner tank 12 of the cold and hot storage 50 according to the second embodiment will be described. When the temperature for heating is set by operating the operation dial 8, the control unit 44 supplies power to the silicone rubber heater 36 and the temperature control fan 32 by the power supply unit 48 in order to heat the inside of the inner tank 12. As a result, the temperature control heat sink 30 is heated by the silicone rubber heater 36. Also, air in the inner tank 12 is blown to the center portion of the temperature control heat sink 30 by the temperature control fan 32 and in the space shielded by the shielding plate 60, the air flows along the plurality of fins 30*b* of the temperature control heat sink 30 toward the end portions on both sides of the temperature control heat sink 30. The air is heated while flowing and the heated air passes through the spaces formed on both the side portions of the temperature control heat sink 30 and is blown out from the air blowing outlets 64 into the inner tank 12.

The air blown out from the air blowing outlets 64 formed at the upper portion of the inner tank 12 flows toward the door 6, i.e., front of the cold and hot storage 50, along the upper surface and side surfaces of the wet towels housed in the cage 13 installed at an upper stage in the inner tank 12. Moreover, the air goes around the front surface of the wet towels. Then, the air passes the lower surface of the wet towels housed in the cage 13 installed at the upper stage and through the wet towels, and reaches the temperature control fan 32, and again, the air is blown to the center portion of the temperature control heat sink 30 by the temperature control fan 32.

In addition, the air blown out from the air blowing outlets 64 formed at the lower portion of the inner tank 12 flows toward the door 6, i.e., toward the front of the cold and hot storage 50, along the lower surface and side surfaces of the wet towels housed in the cage 13 installed at a lower stage of the inner tank 12. Moreover, the air goes around the front surface of the wet towels. Then, the air passes the upper surface of the wet towels housed in the cage 13 installed at the lower stage and between the wet towels, and reaches the temperature control fan 32, and again, the air is blown to the center portion of the temperature control heat sink 30 by the temperature control fan 32.

Therefore, the heated air circulating in the inner tank 12 which flows along the upper portion, the lower portion, and the inner wall on both sides of the inner tank 12 to the front surface side in the inner tank 12 causes the wet towels housed in the inner tank 12 to be efficiently and rapidly heated. Also, because the air flowing from the front surface side in the inner tank 12 toward the temperature control fan 32 passes between the wet towels, a wet towel surrounded by other wet towels is also efficiently and rapidly heated.

In addition, power supply to the silicone rubber heater 36 or the like by the power supply unit 48 is feedback-controlled by using the temperature in the inner tank 12 detected by the temperature sensor 49 so that the temperature in the inner tank 12 becomes the temperature set by the operation dial 8. Therefore, power consumption can be reduced.

According to the cold and hot storage 50 of this second embodiment, when cooling the inside of the inner tank 12 of the cold and hot storage 2, by blowing air in the inner tank 12 to the cooled temperature control heat sink 30, the air in the inner tank 12 is cooled, and the cooled air flows to the inner tank 12 in the front direction from the rear surface side in the inner tank 12, along the upper surface, the lower surface, and the inner walls on both sides in the inner tank 12 to circulate the cooled air in the inner tank 12. Therefore, the inside of the inner tank 12 can be highly efficiently cooled and the wet towels housed in the inner tank 12 can be rapidly cooled with low power consumption. Also, because the air in the inner tank 12 is circulated, it is possible to suppress the occurrence of dew condensation in the inner tank 12 and to suppress the lowering of the cooling efficiency.

Also, when heating the inside of the inner tank 12 of the cold and hot storage 50, by blowing air in the inner tank 12 to the heated temperature control heat sink 30, the air in the inner tank 12 is heated, and the heated air is flowed to the inner tank 12 in the front direction from the rear surface side in the inner tank 12, along the upper surface, the lower surface, and the inner walls on both sides of the inner tank 12 to circulate the heated air in the inner tank 12. Therefore, the inside of the inner tank 12 can be highly efficiently heated and the wet towels housed in the inner tank 12 can be rapidly heated with low power consumption.

In addition, because the silicone rubber heater 36 is superimposed and fixed so as to be in close contact with the temperature control heat sink 30, there is no possibility that the inside of the inner tank cannot be heated due to disconnection from rusting of an electrothermal heater included in an inner tank because of dew condensation as described in Patent Literature 1 mentioned above. Therefore, heating the inside of the inner tank 12 can be performed stably.

Moreover, the partition plate 60*b* for vertically partitioning an area where the temperature control heat sink 30 is arranged is provided on both sides of the temperature control fan facing portion 62 on the back surface side of the shielding plate 60. Therefore, the air blown to the upper half area of the temperature control heat sink 30 by the temperature control fan 32, within the space shielded by the shielding plate 60, flows along the plurality of fins 30*b* of the temperature control heat sink 30 toward the end portions on both sides of the temperature control heat sink 30, and blows into the inner tank 12 from the air blowing outlets 64 formed at the upper portion of the inner tank 12. On the other hand, the air blown to the lower half area of the temperature control heat sink 30 by the temperature control fan 32, in the space shielded by the shielding plate 60, flows along the plurality of fins 30*b* of the temperature control heat sink 30 toward the end portions on both sides of the temperature control heat sink 30, and blows into the inner tank 12 from the air blowing outlets 64 formed at the lower portion of the inner tank 12.

Here, in the case where the partition plate 60*b* is not included on the shielding plate 60, and the wet towels are housed only in the cage 13 installed at the upper stage in the inner tank 12, the air blowing load from the air blowing outlets 64 formed at the upper portion of the inner tank 12 is larger than the air blowing load from the air blowing outlets 64 formed at the lower portion. As a result, a large amount of air is blown out from the air blowing outlets 64 formed at the lower portion of the inner tank 12 as compared with the air blowing outlets 64 formed at the upper portion of the inner tank 12. In the case where the wet towels are housed only in the cage 13 installed at the lower stage in the inner tank 12, the air blowing load from the air blowing outlets 64 formed at the lower portion of the inner tank 12 is larger than the air blowing load from the air blowing outlets 64 formed at the upper portion. As a result, a large amount of air is blown out from the air blowing outlets 64 formed at the upper portion of the inner tank 12 as compared with the air blowing outlets 64 formed at the lower portion of the inner tank 12. As a result, a large amount of air reaches the temperature control fan 32 again without being in contact with the wet towels, and therefore, it is not possible to efficiently cool or heat the wet towels.

However, in a case where the shielding plate 60 includes the partition plate 60*b*, the air blown to the upper half area of the temperature control heat sink 30 by the temperature control fan 32 flows into the space higher than the partition plate 60*b* of the shielding plate 60 along the plurality of fins 30*b* of the temperature control heat sink 30 toward the end portions on both sides of the temperature control heat sink 30, and blows into the inner tank 12 from the air blowing outlets 64 formed at the upper portion of the inner tank 12. On the other hand, the air blown to the lower half area of the temperature control heat sink 30 by the temperature control fan 32 flows into the space lower than the partition plate 60*b* of the shielding plate 60 along the plurality of fins 30*b* of the temperature control heat sink 30 toward the end portions on both sides of the temperature control heat sink 30, and blows into the inner tank 12 from the air blowing outlets 64 formed at the lower portion of the inner tank 12. Therefore, even when the wet towel is housed only in the upper or lower cage 13 in the inner tank 12, it is possible to efficiently cool or heat the wet towel.

Note that in the embodiments described above, although the plate-shaped silicone rubber heater 36 is used for heating in the inner tank 12, a heater including a heater wire may be used. In the case of using the heater including the heater wire, the heater is arranged so that the heater wire is brought into close contact with the base end portion of the fin 30*b*, i.e., the bottom surface of the groove between the fins 30*b*, in a position between the fins 30*b* of the temperature control heat sink 30. In the case where the heater wire is arranged as described above, air blown to the temperature control heat sink 30 by the temperature control fan 32 flows along the heater wire heating the fins 30*b* toward the inner walls on both sides. Therefore, the air can be heated more efficiently and it is possible to rapidly heat the wet towel housed in the inner tank 12 with low power consumption.

Figure 14:
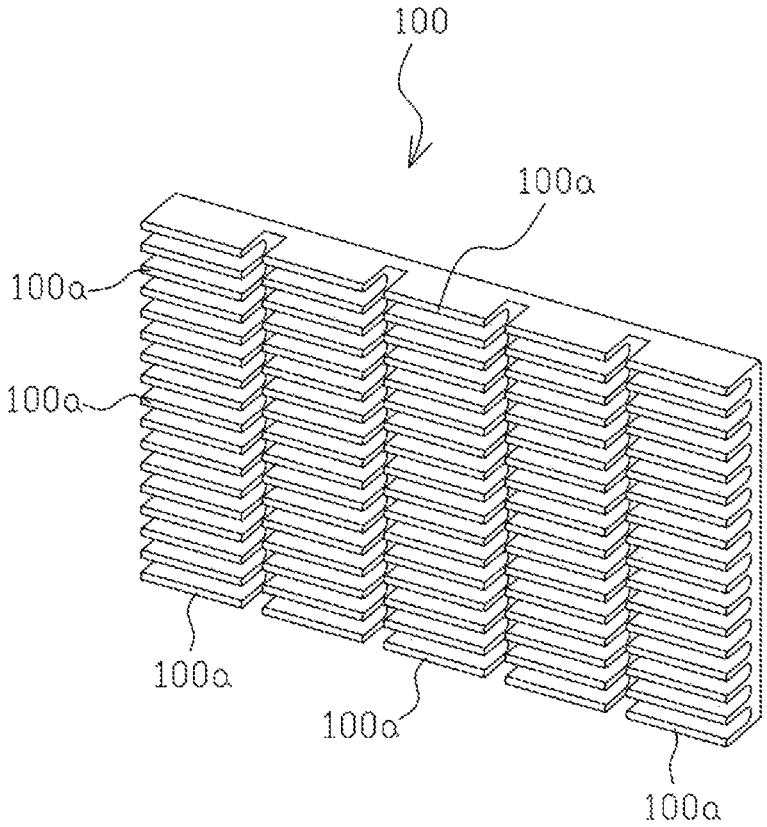
FIG. 14 is a view illustrating a shape of another temperature control heat sink according to the embodiment.

In addition, the temperature control unit 20 according to each of the embodiments described above includes the temperature control heat sink 30 including a plurality of the plate-shaped fins 30*b*. However, the present embodiment is not limited to this, and may include, as illustrated in FIG. 14, a temperature control heat sink 100 on which a plurality of plate-shaped fins 100*a* having a predetermined length is arranged at predetermined intervals in the vertical direction and the lateral direction. In a case of including the temperature control heat sink 100, the air blown by the temperature control fan 32 flows along the groove between the fins 100*a* in the vertical direction and the inner wall direction on both sides. Therefore, the air not only goes around to the front side of the wet towel housed in the inner tank 12 along the inner walls on both sides in the inner tank 12, but the air also goes around to the front surface side of the wet towel housed in the inner tank 12 along the upper surface and the lower surface in the inner tank 12. Therefore, the wet towel housed in the inner tank 12 can be cooled or heated more efficiently. Therefore, it is possible to rapidly cool or rapidly heat the wet towel housed in the inner tank 12 with low power consumption.

Figure 15:
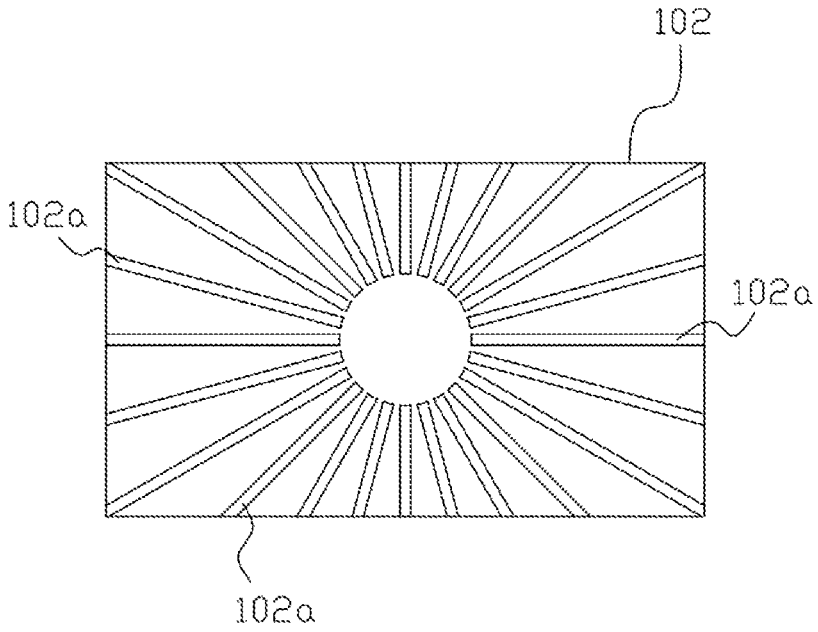
FIG. 15 is a view illustrating a shape of another temperature control heat sink according to the embodiment.

In addition, the temperature control unit 20 may include a temperature control heat sink 102 including a plurality of plate-shaped fins 102*a* extending radially from the center portion of the temperature control heat sink 102 as illustrated in FIG. 15. In a case of using this temperature control heat sink 102, air blown by the temperature control fan 32 flows radially along the groove between the fins 102*a* and the air not only goes around to the front surface side of the wet towel housed in the inner tank 12 along the inner walls on both sides in the inner tank 12, but the air also goes around to the front side of the wet towel housed in the inner tank 12 along the upper surface and the lower surface in the inner tank 12. Therefore, the wet towel housed in the inner tank 12 can be cooled or heated more efficiently. Therefore, it is possible to rapidly cool or rapidly heat the wet towel housed in the inner tank 12 with low power consumption.

In addition, a temperature control heat sink having pin-shaped fins may be included. Also, in this case. Air blown by the temperature control fan 32 passes through the pin-shaped fins and the air not only goes around to the front surface side of the wet towel housed in the inner tank 12, along the inner walls on both sides in the inner tank 12, but the air also goes around to the front side of the wet towel housed in the inner tank 12, along the upper surface and the lower surface in the inner tank 12. Therefore, the wet towel housed in the inner tank 12 can be cooled or heated more efficiently. Therefore, it is possible to rapidly cool or rapidly heat the wet towel housed in the inner tank 12 with low power consumption.

Figure 16:
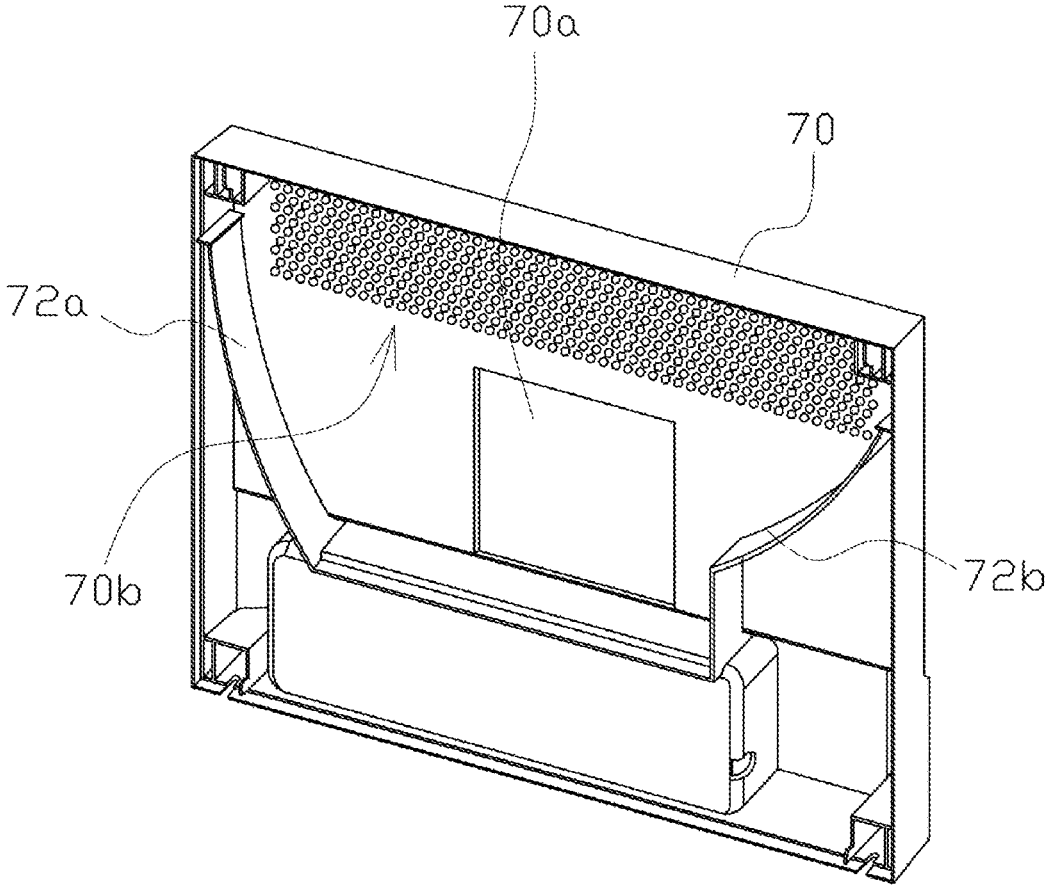
FIG. 16 is a perspective view of a rear panel of the cold and hot storage according to the embodiment.

In addition, the rear panel 18 according to each of the embodiments described above may be changed to a rear panel 70 illustrated in FIG. 16. FIG. 16 is a perspective view illustrating the inner surface side of the rear panel 70. The rear panel 70 includes an air intake port 70*a* at a position facing the heat dissipation fan 26, a plurality of openings 70*b* in a region extending in the width direction of the rear panel 70 above the air intake port 70*a*, and air guides 72*a* and 72*b* for guiding to the plurality of openings 70*b* the air between the rear panel 70 and the rear surface portion partition 19. To be specific, the rear panel 70 includes the first air guide 72*a* extending from the vicinity of the lower portion of one side of the heat dissipation heat sink 24 toward one side of the upper inner wall of the rear panel 70, and the second air guide 72*b* extending from the vicinity of the lower portion of the other side of the heat dissipation heat sink toward the other side of the upper inner wall of the rear panel. Note that in the rear panel 70, although the first air guide 72*a* and the second air guide 72*b* are formed integrally with the rear panel 70, these air guides may be formed integrally with the rear surface portion partition 19 or separately from the rear panel 70 and the rear surface portion partition 19.

With the air guides 72*a* and 72*b*, the air warmed by the heat dissipation heat sink 24 is guided to the plurality of openings 70*b* along the first air guide 72*a* and the second air guide 72*b* without staying around the heat dissipation heat sink 24 and is discharged to the outside of the storage from the openings 70*b*. Therefore, it is possible to effectively cool the inside of the inner tank 12 without reducing the cooling effect.

Also, in each of the embodiments described above, the cold and hot storage 2 or 50 cools or heats a wet towel, but may cool or heat a canned beverage.

Next, results of cooling and heating tests of wet towels folded into a bar shape using the cold and hot storage 50 according to the second embodiment and a conventional type cold and hot storage having a similar configuration to the cold and hot storage described in the related art will be described. In this test, a total of 30 wet towels, i.e., three layers of ten wet towels are housed in cage 13 placed in the upper stage of the inner tank 12, and a total of 30 wet towels, i.e., three layers of ten wet towels are housed in cage 13 placed in the lower stage of the inner tank 12. When heating is performed at the temperature of the wet towels of the second layer among the three layers of wet towels accommodated in the cage 13 of the upper stage and at the temperature of the second layer wet towel among the three layers of wet towels accommodated in the lower cage 13, the time to reach 50 degrees and 60 degrees after storing the wet towel in the cold storage was measured, and when cooling is performed at that temperature, the time to reach 15 degrees and 10 degrees was measured after storing the wet towel in the cold storage.

Table 1 illustrates the time until the temperature of the wet towels reaches 50 degrees and 60 degrees after storing the wet towels in the cold and hot storage 50, in a case of heating the wet towels by the cold and hot storage 50, for each of the upper cage (upper stage) and the lower cage (lower stage). Also, Table 2 illustrates the time until the temperature of the wet towels reaches 50 degrees and 60 degrees after storing the wet towels in the conventional type cold and hot storage, in a case of heating the wet towels by the conventional type cold and hot storage for each of the upper cage (upper stage) and the lower cage (lower stage). As illustrated in Tables 1 and 2, the wet towels could be heated more rapidly by heating the wet towels by the cold and hot storage 50 than the conventional type cold and hot storage. Also, the wet towels in the second layer among the wet towels layered in three could be heated rapidly in a case of heating the wet towels by the cold and hot storage 50.

TABLE 1

| Wet towel temperature reaching time | | |
|---|---|---|
| | 50° C. | 60° C. |
| Upper stage | 75 minutes | 123 minutes |
| Lower stage | 73 minutes | 120 minutes |

TABLE 2

| Wet towel temperature reaching time | | |
|---|---|---|
| | 50° C. | 60° C. |
| Upper stage | 165 minutes | 262 minutes |
| Lower stage | 119 minutes | 229 minutes |

Table 3 illustrates the time until the temperature of the wet towels reach 15 degrees and 10 degrees after storing the wet towels in the cold and hot storage 50, in a case of cooling the wet towels by the cold and hot storage 50 for each of the upper cage (upper stage) and the lower cage (lower stage). Also, Table 4 illustrates the time until the temperature of the wet towels reaches 15 degrees and 10 degrees after storing the wet towels in the conventional type cold and hot storage, in a case of cooling the wet towels by the cold and hot storage for each of the upper cage (upper stage) and the lower cage (lower stage). As illustrated in Tables 3 and 4, the wet towels could be cooled more rapidly by cooling the wet towels by the cold and hot storage 50 than the conventional type cold and hot storage. Also, the wet towels in the second layer among the wet towels layered in three could be cooled rapidly in a case of cooling the wet towels by the cold and hot storage 50.

TABLE 3

| Wet towel temperature reaching time | | |
|---|---|---|
| | 15° C. | 10° C. |
| Upper stage | 107 minutes | 199 minutes |
| Lower stage | 103 minutes | 190 minutes |

TABLE 4

| Wet towel temperature reaching time | | |
|---|---|---|
| | 15° C. | 10° C. |
| Upper stage | 215 minutes | 348 minutes |
| Lower stage | 184 minutes | 335 minutes |

The invention claimed is:

1. A cold and hot storage comprising:

a main body portion including a door on a front surface;

an inner tank arranged in the main body portion;

a temperature control heat sink including a base plate and a plurality of fins formed on one surface of the base plate having the other surface arranged along a rear surface in the inner tank;

a heater that heats the temperature control heat sink;

a temperature control fan that blows air in the inner tank to the fins of the temperature control heat sink;

a shielding plate that includes a plurality of through holes and a temperature control fan facing portion facing the temperature control fan and shields an area where the temperature control heat sink is arranged in a state that air blowing outlets are formed on upper and lower portions of the inner tank;

a heat dissipation heat sink arranged outside the rear surface of the inner tank;

a heat dissipation fan that blows air outside the inner tank to the heat dissipation heat sink;

a Peltier module having a heat absorbing surface to be connected to the temperature control heat sink and a heat dissipating surface to be connected to the heat dissipation heat sink; and a power controller that supplies power to the heater and the temperature control fan in a case of heating an inside of the inner tank and to the temperature control fan, the heat dissipation fan, and the Peltier module in a case of cooling the inside of the inner tank.

2. The cold and hot storage according to claim 1, wherein spaces communicating with the air blowing outlets are formed to a right and a left of the temperature control heat sink in the inner tank.

3. The cold and hot storage according to claim 1, wherein:

the shielding plate includes a partition plate that partitions vertically an area between the temperature control heat sink and of the shielding plate.

4. The cold and hot storage according to claim 1, further comprising:

an outer panel and a rear panel configuring the main body portion;

a partition formed between the rear panel of an inner side of the outer panel and the inner tank; and at least one air guide that guides air between the rear panel and the partition to at least one opening of the rear panel, wherein the rear panel includes an air intake port at a position facing the heat dissipation fan and at least one opening at an area extending in a width direction of the rear panel above the air intake port.

5. The cold and hot storage according to claim 4, wherein the at least one air guide comprises:

a first air guide extending from a left lower area toward a left upper area between the rear panel and the partition; and a second air guide extending from a right lower area toward a right upper area between the rear panel and the partition.

6. A cold and hot storage comprising:

a main body portion including a door on a front surface;

an inner tank arranged in the main body portion;

a temperature control heat sink including a base plate and a plurality of fins formed on one surface of the base plate having the other surface arranged along a rear surface in the inner tank;

a heater that heats the temperature control heat sink;

a temperature control fan that blows air in the inner tank to the fins of the temperature control heat sink;

a plate portion that is positioned on first and second sides of the temperature control fan and covers an upper portion of the plurality of fins;

a heat dissipation heat sink arranged outside the rear surface of the inner tank;

a heat dissipation fan that blows air outside the inner tank to the heat dissipation heat sink;

a Peltier module having a heat absorbing surface to be connected to the temperature control heat sink and a heat dissipating surface to be connected to the heat dissipation heat sink; and a power controller that supplies power to the heater and the temperature control fan in a case of heating an inside of the inner tank and to the temperature control fan, the heat dissipation fan, and the Peltier module in a case of cooling the inside of the inner tank.

7. The cold and hot storage according to claim 1, wherein the temperature control fan is arranged at the center of a surface forming the fins of the temperature control heat sink.

8. The cold and hot storage according to claim 1, wherein the heater is a plate-shaped sheet heater and arranged in close contact with a surface without the fins of the base plate.

9. The cold and hot storage according to claim 1, wherein the heater includes a heater wire and the heater wire is arranged in close contact with a base end portion of the fins between the fins.

10. The cold and hot storage according to claim 1, wherein the fins are plate-shaped fins extending toward an inner wall on both sides of the inner tank.

11. The cold and hot storage according to claim 1, wherein the fins are plate-shaped fins having a predetermined length and a plurality of the fin is arranged at predetermined intervals in a vertical direction and a lateral direction.

12. The cold and hot storage according to claim 1, wherein the fins are plate-shaped fins extending radially from the center portion of the temperature control heat sink.

13. The cold and hot storage according to claim 1, wherein the temperature control fan blows air in the inner tank to the plurality of fins of the temperature control heat sink and circulates the air in the inner tank through a groove formed between the plurality of fins.

14. A cold and hot storage comprising:

a main body portion including a door on a front surface;

an inner tank arranged in the main body portion;

a temperature control heat sink arranged in the inner tank;

a heater that heats the temperature control heat sink;

a temperature control fan arranged on a front surface of the temperature control heat sink and blows air in the inner tank to the front surface of the temperature control heat sink;

a heat dissipation heat sink arranged outside a rear of the inner tank;

a heat dissipation fan that blows air outside the inner tank to the heat dissipation heat sink;

a Peltier module having a heat absorbing surface to be connected to the temperature control heat sink and a heat dissipating surface to be connected to the heat dissipation heat sink; and a power controller that supplies power to the heater and the temperature control fan in a case of heating an inside of the inner tank and to the temperature control fan, the heat dissipation fan, and the Peltier module in a case of cooling the inside of the inner tank.

15. The cold and hot storage according to claim 14, further comprising:

an outer panel and a rear panel configuring the main body portion;

a partition formed between the rear panel of an inner side of the outer panel and the inner tank; and at least one air guide that guides air between the rear panel and the partition to at least one opening of the rear panel, wherein the rear panel includes an air intake port at a position facing the heat dissipation fan and at least one opening at an area extending in a width direction of the rear panel above the air intake port.

16. The cold and hot storage according to claim 15, wherein the at least one air guide comprises:

a first air guide extending from a left lower area toward a left upper area between the rear panel and the partition; and a second air guide extending from a right lower area toward a right upper area between the rear panel and the partition.

17. The cold and hot storage according to claim 14, wherein the inner tank houses a wet towel and heats or cools the wet towel.

18. The cold and hot storage according to claim 6, wherein the temperature control fan is arranged at the center of a surface forming the fins of the temperature control heat sink.

19. The cold and hot storage according claim 6, wherein the heater is a plate-shaped sheet heater and arranged in close contact with a surface without fins of the base plate.

20. The cold and hot storage according to claim 6, wherein the heater includes a heater wire and the heater wire is arranged in close contact with a base end portion of the fins between the fins.

* * * * *